US011364702B2

(12) United States Patent
Huang

(10) Patent No.: US 11,364,702 B2
(45) Date of Patent: Jun. 21, 2022

(54) STRAW FORMING MACHINE

(71) Applicant: Chien-Ming Huang, Taichung (TW)

(72) Inventor: Chien-Ming Huang, Taichung (TW)

( * ) Notice: Subject to any disclaimer, the term of this patent is extended or adjusted under 35 U.S.C. 154(b) by 441 days.

(21) Appl. No.: 16/655,317

(22) Filed: Oct. 17, 2019

(65) Prior Publication Data

US 2021/0114327 A1 Apr. 22, 2021

(51) Int. Cl.

| | |
|---|---|
| ***B31D 5/00*** | (2017.01) |
| ***B26D 3/16*** | (2006.01) |
| *A47G 21/18* | (2006.01) |

(52) U.S. Cl.

CPC ..... *B31D 5/0095* (2013.01); *B26D 3/16* (2013.01); *A47G 21/18* (2013.01); *A47G 2400/10* (2013.01)

(58) Field of Classification Search

CPC ..... B31D 5/0095; B65B 49/00; B65B 49/02; B65B 9/14; B65B 9/00; B65B 9/06; B65B 9/067; B65B 9/073; B65B 9/20; B65B 9/2014; B65B 9/2021; B65B 9/2028; B65B 9/207; B65B 9/213; B26D 3/16; A47G 21/18; A47G 2400/10

USPC ..... 493/301, 288, 269, 276, 272, 287, 302, 493/416, 436, 438, 442, 443, 446, 447

See application file for complete search history.

(56) References Cited

U.S. PATENT DOCUMENTS

| | | | | |
|---|---|---|---|---|
| 6,209,286 | B1 * | 4/2001 | Perkins | B65D 81/052 53/553 |
| 2014/0206515 | A1 * | 7/2014 | Hanten | B31F 5/00 493/269 |
| 2018/0118390 | A1 * | 5/2018 | Mulder | B65B 31/04 |
| 2021/0037999 | A1 * | 2/2021 | Salomäki | B65D 77/283 |

* cited by examiner

*Primary Examiner* — Chelsea E Stinson

(74) *Attorney, Agent, or Firm* — Alan D. Kamrath; Karin L. Williams; Mayer & Williams PC

(57) ABSTRACT

A straw forming machine includes a feeding device, a pressing device, a sticking device, a conveyor device, and a cutting device. The paper material is stretched from the feeding device to the pressing device which curls the paper material. When the paper material is delivered to the sticking device, the two sides of the paper material are pressed by the sticking device to form the paper pipe, and the press roll of the sticking device rolls and sticks the two abutting portions of the paper pipe. Then, the paper pipe is delivered by the conveyor device to the cutting device which cuts the paper pipe to form drinking straws.

6 Claims, 12 Drawing Sheets

STRAW FORMING MACHINE

BACKGROUND OF THE INVENTION

1. Field of the Invention

The present invention relates to a forming machine and, more particularly, to a straw forming machine for forming a paper drinking straw.

2. Description of the Related Art

A conventional drinking straw is made of plastic material which easily causes environmental problems. Another conventional drinking straw is made of paper material to achieve an environmental protection purpose. However, the paper drinking straw is not made easily and has a greater cost of fabrication. In addition, the paper drinking straw is stuck by adhesive that increases the cost of production.

BRIEF SUMMARY OF THE INVENTION

In accordance with the present invention, there is provided a straw forming machine comprising a feeding device, a pressing device, a sticking device, a conveyor device, and a cutting device. The feeding device includes a plurality of drawing rollers for feeding, leveling, calibrating and stretching a paper material. The pressing device is located in front of the feeding device, to curl two sides of the paper material upward. The pressing device includes a first press plate, a second press plate, a third press plate, a fourth press plate, and a bottom plate. Each of the first press plate, the second press plate, the third press plate, and the fourth press plate gradually tapers downward and forms a first arcuate portion, a second arcuate portion, a third arcuate portion, and a fourth arcuate portion. The first arcuate portion, the second arcuate portion, the third arcuate portion, and the fourth arcuate portion gradually changes and tapers from a semicircular shape into a circular shape. The pressing device further includes a first rolling ball mounted on a bottom of the first arcuate portion, a second rolling ball mounted on a bottom of the second arcuate portion, a third rolling ball mounted on a bottom of the third arcuate portion, and a fourth rolling ball mounted on a bottom of the fourth arcuate portion. The bottom plate is arranged under the first press plate, the second press plate, the third press plate, and the fourth press plate. The bottom plate is changed corresponding to variation of the first arcuate portion of the first press plate, the second arcuate portion of the second press plate, the third arcuate portion of the third press plate, and the fourth arcuate portion of the fourth press plate, and gradually changes and tapers from a semicircular shape into a circular shape. The bottom plate has two sides each formed with a clamping slit positioning each of the two sides of the paper material. The sticking device is located in front of the pressing device, to overlap and adhere the two sides of the paper material, to form a paper pipe. The sticking device includes a mounting tube, an air inlet pipe connected to the mounting tube, a hot air pipe located above the mounting tube, a forming hole mounted on the mounting tube, and a press roll located above the mounting tube. The mounting tube is provided with a plurality of vent holes. The air inlet pipe introduces air into the mounting tube. The conveyor device is located in front of the sticking device to deliver the paper pipe. The conveyor device includes two delivery mechanisms located at two sides of the paper pipe and clamping the paper pipe. Each of the two delivery mechanisms includes two rollers and a belt mounted around the two rollers. The cutting device is located in front of the conveyor device, to cut the paper pipe into a plurality of drinking straws. The cutting device includes more than one cutter, a positioning frame, and a cutting platform.

According to the primary advantage of the present invention, the hot air pipe blows hot air toward the paper material to hot melt the surface of the paper material, and to overlap and connect the two sides of the paper material, and the press roll uses a high frequency or ultrasonic wave to hot press and stick the two abutting portions of the paper pipe together, such that the drinking straw does not contain adhesive residual and has a lower cost of fabrication.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
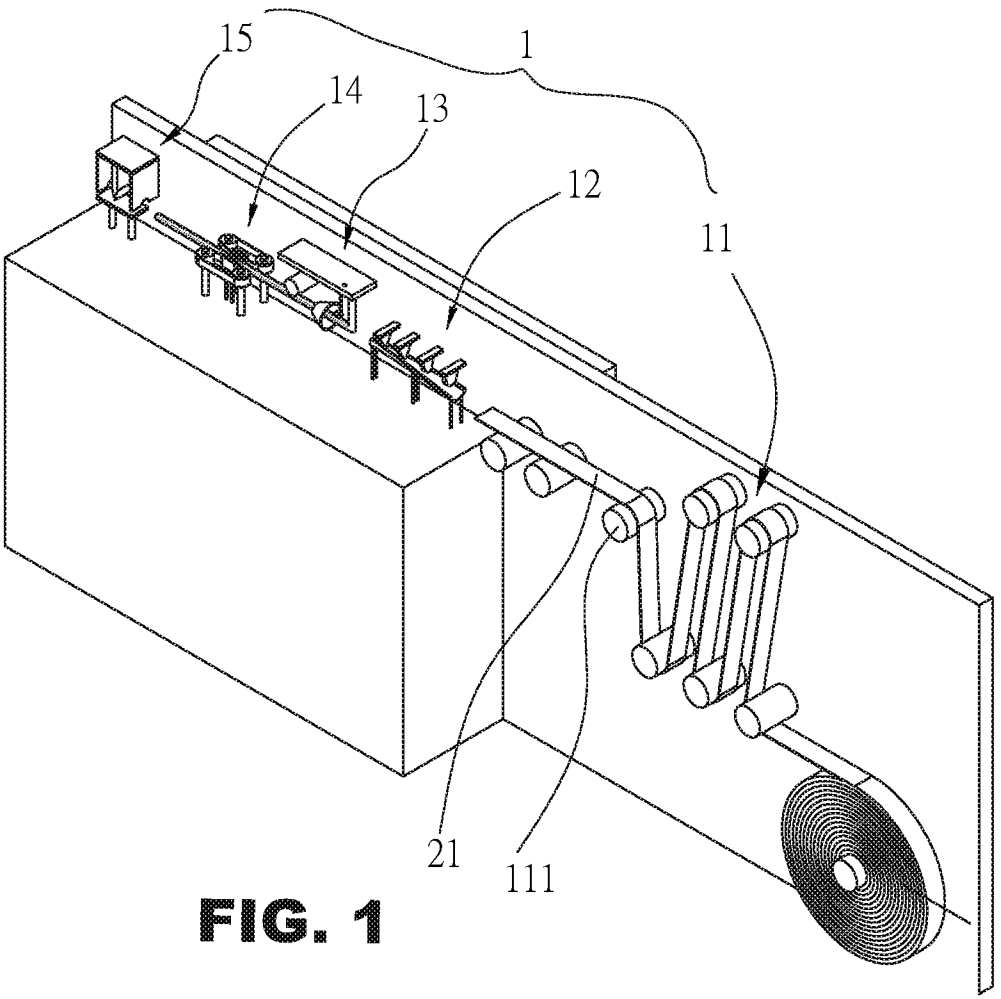
FIG. 1 is a perspective view of a straw forming machine in accordance with the preferred embodiment of the present invention.
Figure 2:
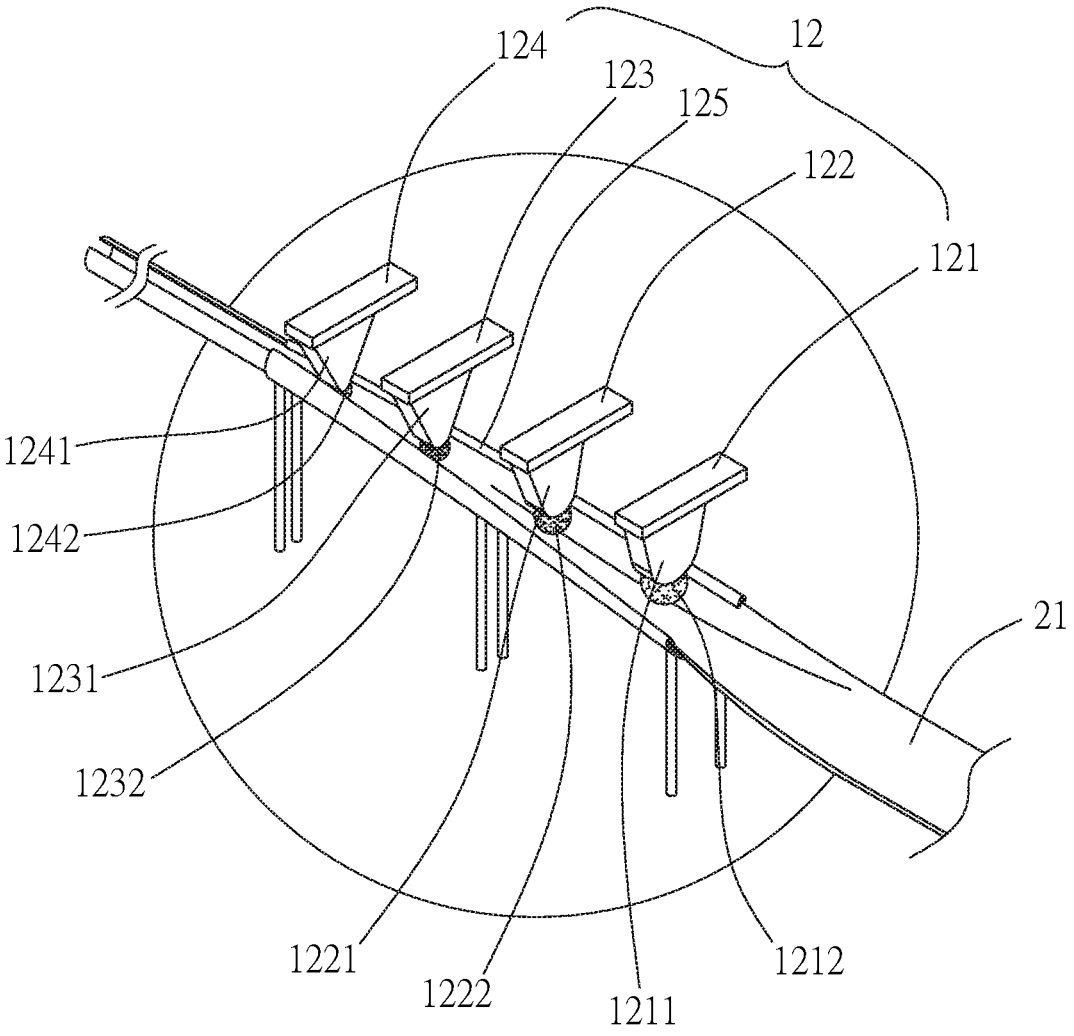
FIG. 2 is a perspective view of a pressing device of the straw forming machine in accordance with the preferred embodiment of the present invention.
Figure 3:
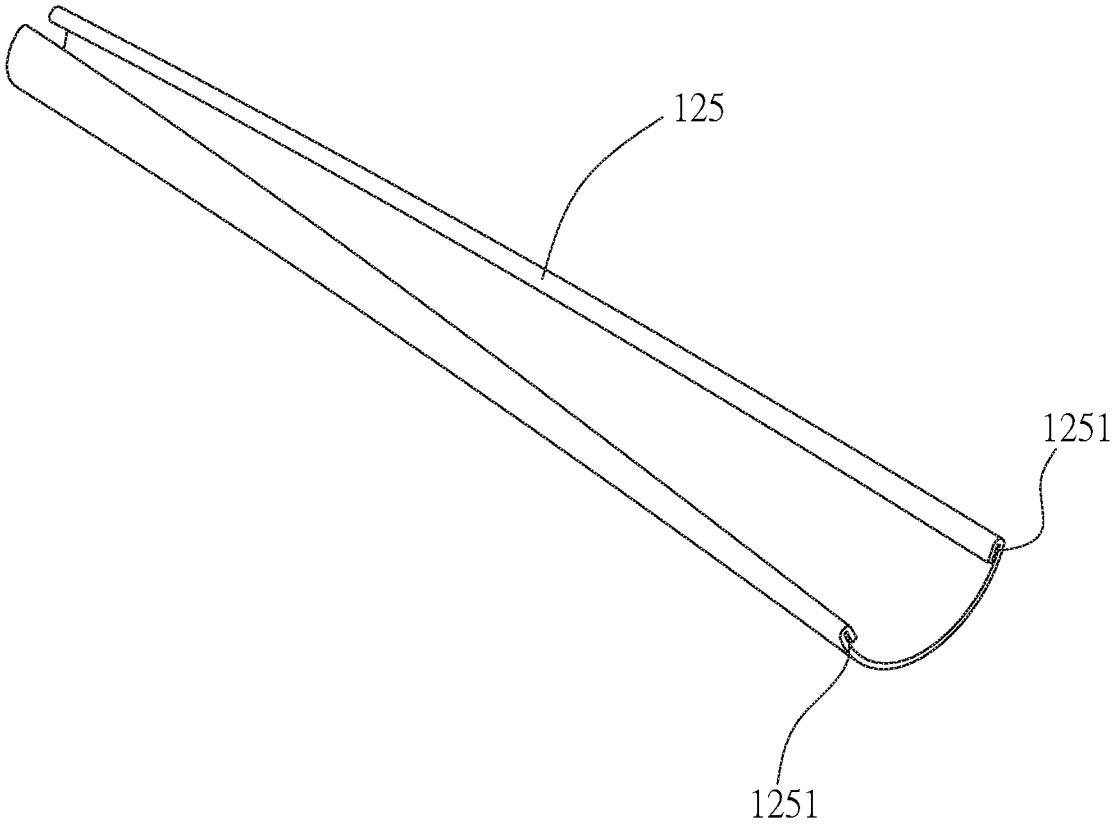
FIG. 3 is a perspective view of a bottom plate of the straw forming machine in accordance with the preferred embodiment of the present invention.
Figure 4:
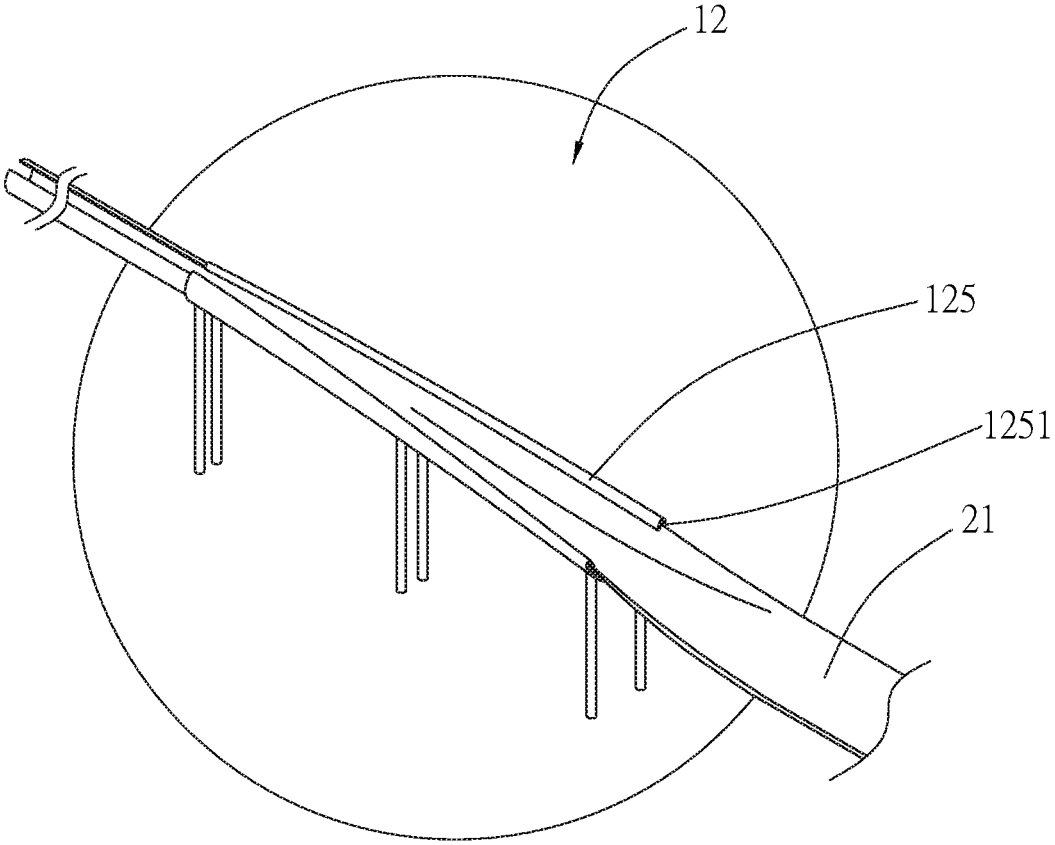
FIG. 4 is a perspective view showing the paper material is clamped by the bottom plate.
Figure 5:
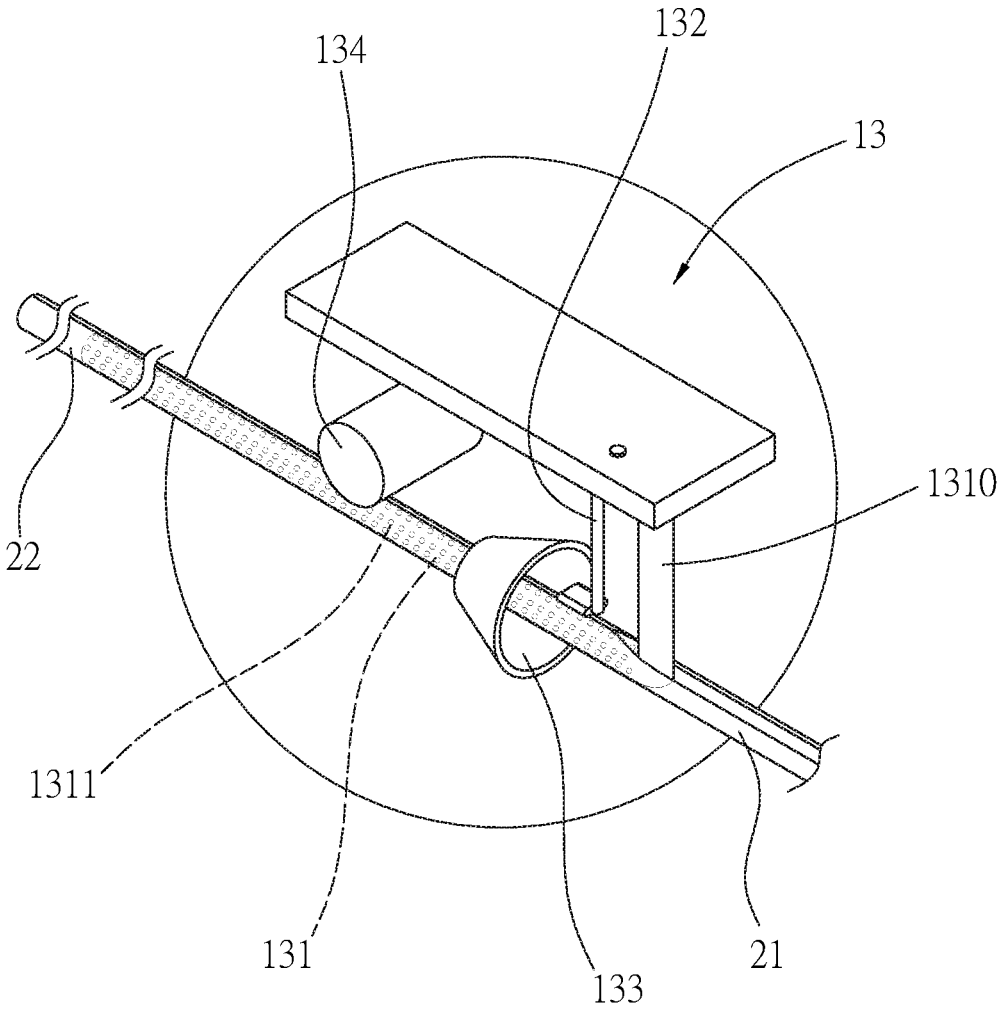
FIG. 5 is a perspective view of a sticking device of the straw forming machine in accordance with the preferred embodiment of the present invention.
Figure 6:
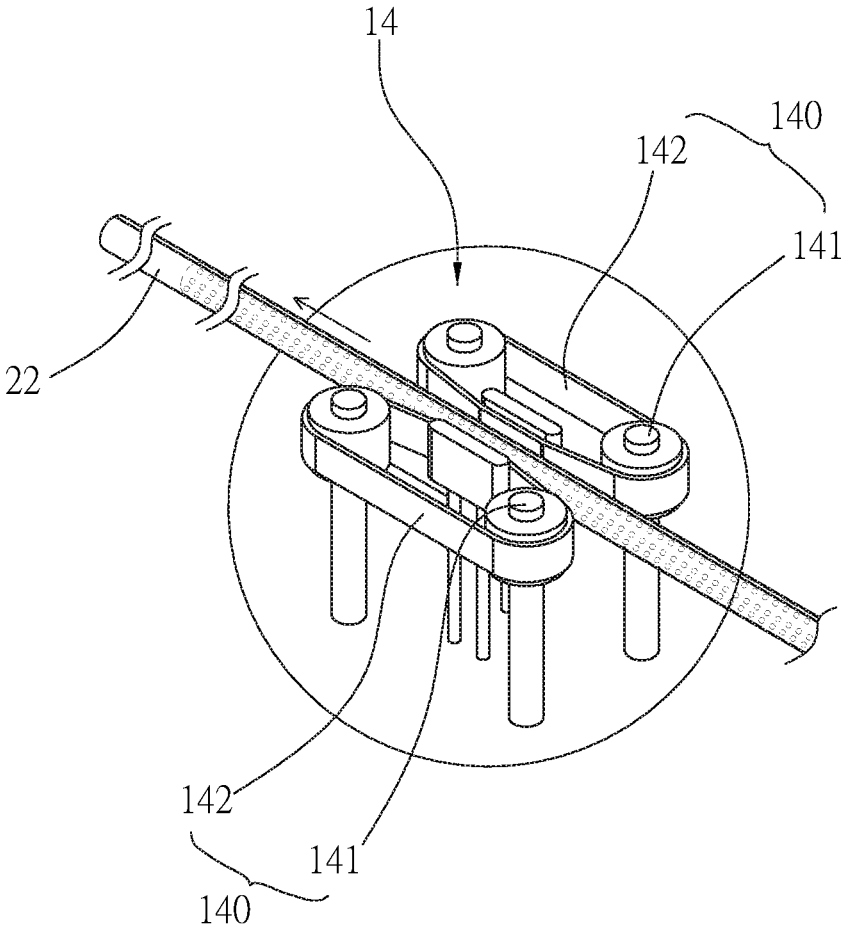
FIG. 6 is a perspective view of a conveyor device of the straw forming machine in accordance with the preferred embodiment of the present invention.
Figure 7:
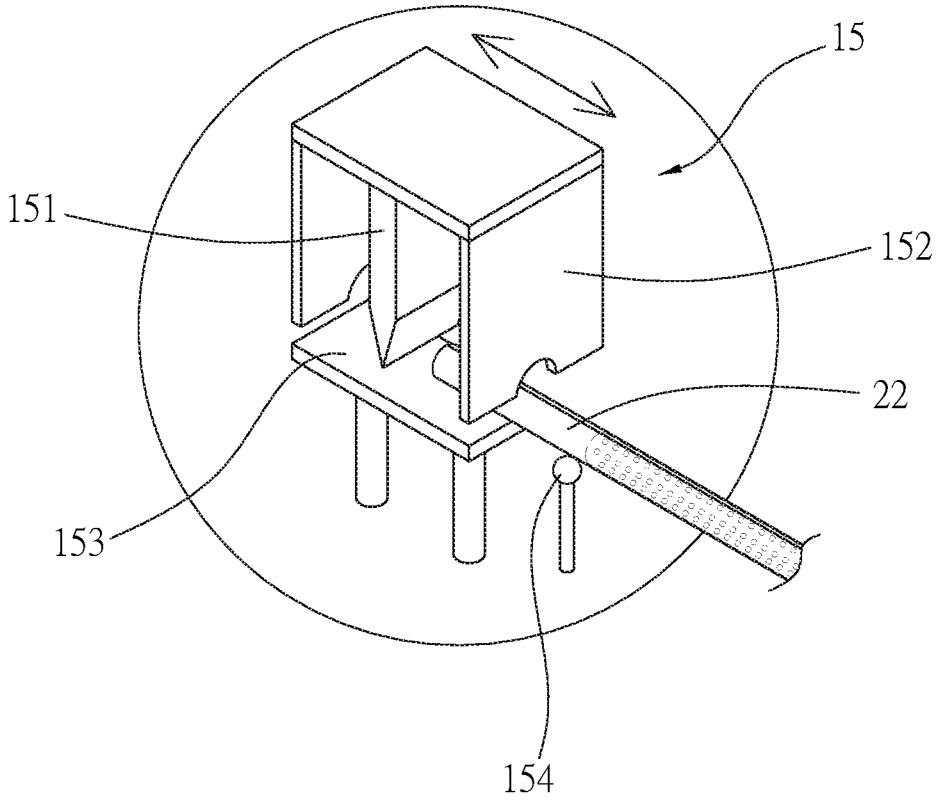
FIG. 7 is a perspective view of a cutting device of the straw forming machine in accordance with the preferred embodiment of the present invention.
Figure 8:
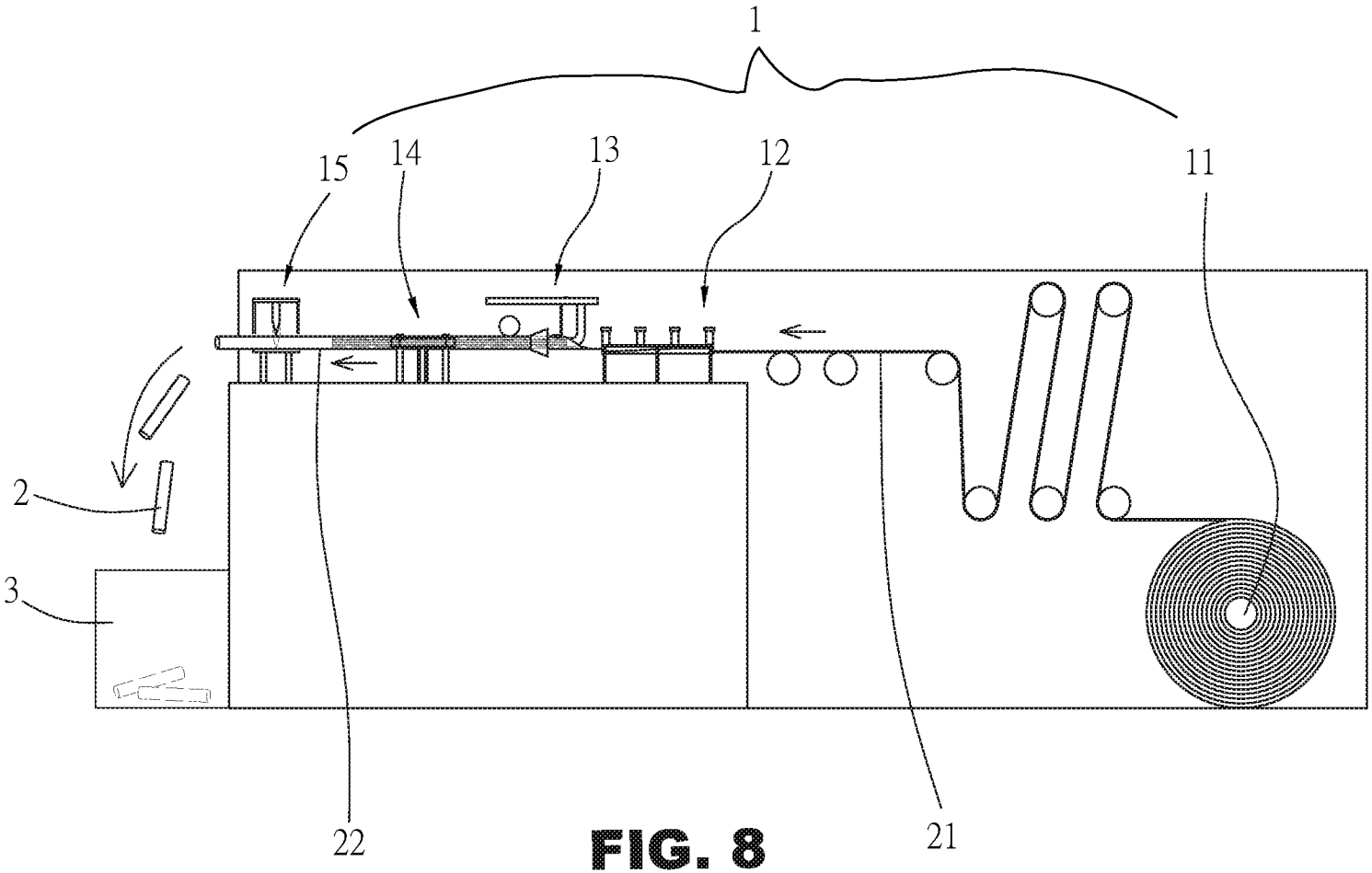
FIG. 8 is a side view of the straw forming machine in accordance with the preferred embodiment of the present invention.
Figure 9:
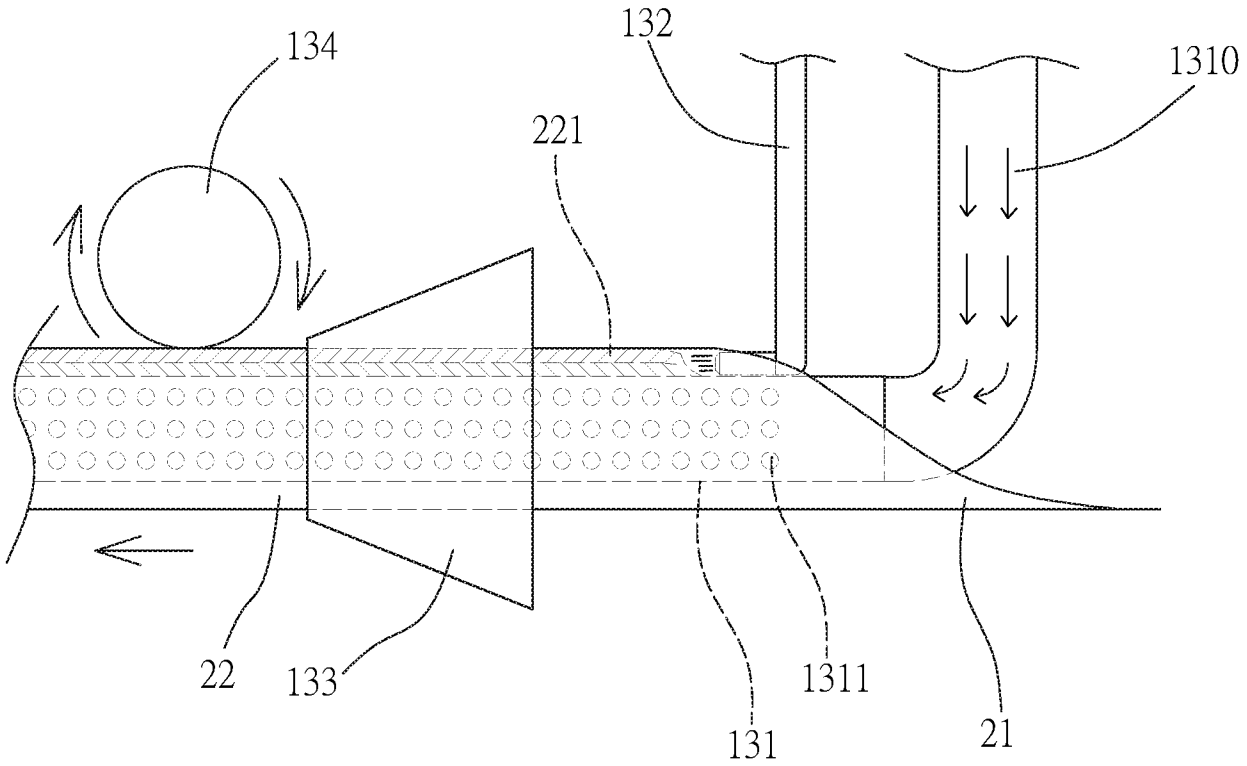
FIG. 9 is a cross-sectional view of the sticking device of the straw forming machine in accordance with the preferred embodiment of the present invention.
Figure 10:
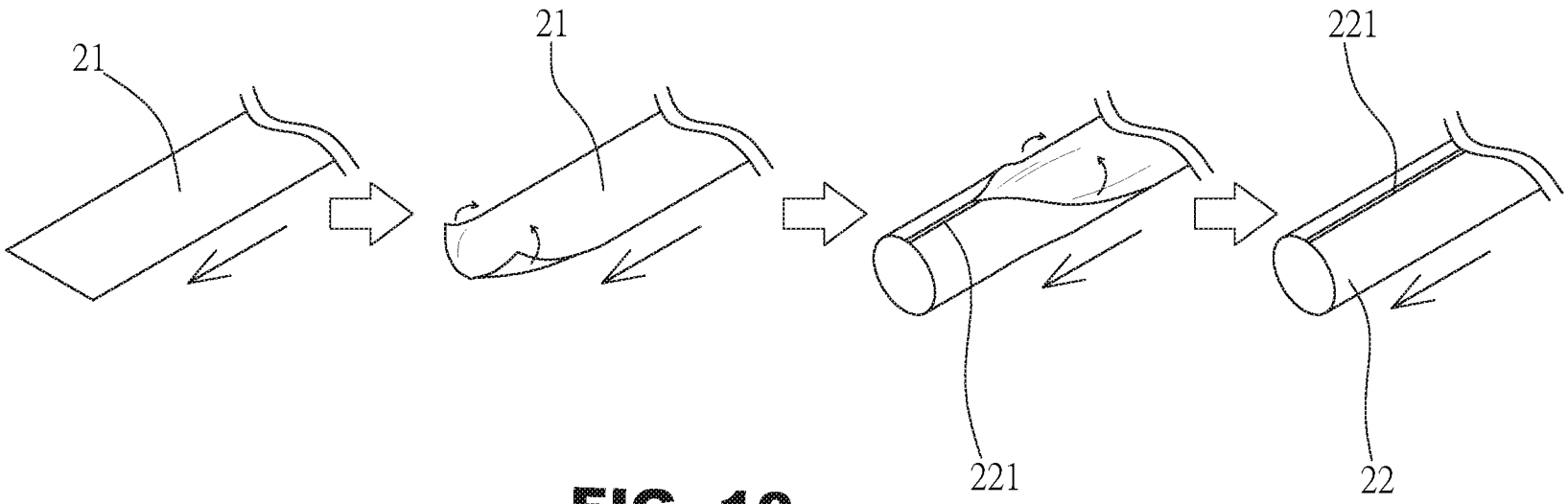
FIG. 10 is a flow chart showing the paper material is curled to form a paper pipe.

Referring to the drawings and initially to FIGS. 1-10, a straw forming machine 1 in accordance with the preferred embodiment of the present invention comprises a feeding device 11, a pressing device 12, a sticking device 13, a conveyor device 14, and a cutting device 15.

The feeding device 11 includes a plurality of drawing rollers 111 for feeding, leveling, calibrating and stretching a paper material 21.

The pressing device 12 is located in front of the feeding device 11, to curl two sides of the paper material 21 upward.

The pressing device 12 includes a first press plate 121, a second press plate 122, a third press plate 123, a fourth press plate 124, and a bottom plate 125. Each of the first press plate 121, the second press plate 122, the third press plate 123, and the fourth press plate 124 gradually tapers downward and forms a first arcuate portion 1211, a second arcuate portion 1221, a third arcuate portion 1231, and a fourth arcuate portion 1241. The first arcuate portion 1211, the second arcuate portion 1221, the third arcuate portion 1231, and the fourth arcuate portion 1241 gradually changes and tapers from a semicircular shape into a circular shape. The pressing device 12 further includes a first rolling ball 1212 mounted on a bottom of the first arcuate portion 1211, a second rolling ball 1222 mounted on a bottom of the second arcuate portion 1221, a third rolling ball 1232 mounted on a bottom of the third arcuate portion 1231, and a fourth rolling ball 1242 mounted on a bottom of the fourth arcuate portion 1241. The bottom plate 125 is arranged under the first press plate 121, the second press plate 122, the third press plate 123, and the fourth press plate 124. The bottom plate 125 is changed corresponding to variation of the first arcuate portion 1211 of the first press plate 121, the second arcuate portion 1221 of the second press plate 122, the third arcuate portion 1231 of the third press plate 123, and the fourth arcuate portion 1241 of the fourth press plate 124, and gradually changes and tapers from a semicircular shape into a circular shape. The bottom plate 125 has two sides each formed with a clamping slit 1251 positioning each of the two sides of the paper material 21, to prevent the paper material 21 from being deflected.

The sticking device 13 is located in front of the pressing device 12, to overlap and adhere the two sides of the paper material 21, to form a paper pipe (or tube) 22. The sticking device 13 includes a mounting tube (or core tube) 131, an air inlet pipe 1310 connected to the mounting tube 131, a hot air pipe 132 located above the mounting tube 131, a forming hole 133 mounted on the mounting tube 131, and a press roll (or roller) 134 located above the mounting tube 131. The mounting tube 131 is provided with a plurality of vent holes 1311. The air inlet pipe 1310 introduces air into the mounting tube 131.

The conveyor device 14 is located in front of the sticking device 13 to deliver the paper pipe 22. The conveyor device 14 includes two delivery mechanisms 140 located at two sides of the paper pipe 22 and clamping the paper pipe 22. Each of the two delivery mechanisms 140 includes two rollers 141 and a belt 142 mounted around the two rollers 141.

The cutting device 15 is located in front of the conveyor device 14, to cut the paper pipe 22 into a plurality of drinking straws 2. The cutting device 15 includes more than one cutter 151, a positioning frame 152, and a cutting platform 153. The more than one cutter 151 is located in the positioning frame 152, and is moved in concert with the positioning frame 152. The cutting platform 153 is located under the positioning frame 152. The paper pipe 22 is placed on the cutting platform 153, and the more than one cutter 151 cuts the paper pipe 22 into the drinking straws 2 at constant time and constant position.

In the preferred embodiment of the present invention, when the paper material 21 passes through the forming hole 133 of the sticking device 13, the two sides of the paper material 21 are curled and form the paper pipe 22 which has two abutting portions 221 overlapping each other.

In the preferred embodiment of the present invention, the press roll 134 of the sticking device 13 has a high frequency or ultrasonic wave (or shock), to hot press the two abutting portions 221 of the paper pipe 22 and stick the two abutting portions 221 of the paper pipe 22 together.

In the preferred embodiment of the present invention, the positioning frame 152 of the cutting device 15 is movable upward and downward and movable forward and backward. In addition, the more than one cutter 151 is moved with the positioning frame 152 and performs a movable cutting work corresponding to movement of the paper pipe 22.

In the preferred embodiment of the present invention, a sensor (or detector) 154 is mounted between the cutting device 15 and the conveyor device 14, and is electrically connected with the positioning frame 152 of the cutting device 15. The sensor 154 starts the positioning frame 152 to drive the more than one cutter 151 to perform a cutting work after the paper pipe 22 passes through the sensor 154 during a preset time.

Thus, the straw forming machine 1 delivers the paper material 21 successively from the feeding device 11 to the cutting device 15, such that the paper material 21 is curled from a flat shape into a tubular shape, and is hot pressed and stuck to form the paper pipe 22 which is cut into the drinking straws 2.

In operation, referring to FIGS. 8-11 with reference to FIGS. 1-7, the paper material 21 is stretched from the feeding device 11 to the pressing device 12 which presses and curls the paper material 21, such that the two sides of the paper material 21 are curled upward and toward the center of the paper material 21. The first rolling ball 1212 of the first press plate 121, the second rolling ball 1222 of the second press plate 122, the third rolling ball 1232 of the third press plate 123, and the fourth rolling ball 1242 of the fourth press plate 124 are used to drive and deliver the paper material 21 forward, such that the paper material 21 enters the sticking device 13. When the paper material 21 is delivered from the pressing device 12 to enter the mounting tube 131 of the sticking device 13, the two sides of the paper material 21 are curled upward to the top of the paper material 21. At this time, the hot air pipe 132 introduces and blows hot air toward the paper material 21 to hot melt the laminating layer on the surface of the paper material 21. Then, the paper material 21 enters the forming hole 133, such that the two sides of the paper material 21 are pressed by the forming hole 133 and are juxtaposed to each other to form the paper pipe 22 which has two abutting portions 221 overlapping each other. Then, the press roll 134 rolls and presses the two abutting portions 221 of the paper pipe 22, such that the two abutting portions 221 of the paper pipe 22 are bonded together closely and tightly. At this time, the air inlet pipe 1310 introduces air into the mounting tube 131, and the air is drained outward from the vent holes 1311 of the mounting tube 131, such that the paper pipe 22 will not be stuck on the mounting tube 131. The paper pipe 22 is delivered forward successively by forward rotation of the press roll 134. When the paper pipe 22 enters the conveyor device 14, the two delivery mechanisms 140 of the conveyor device 14 are located at the two sides of the paper pipe 22 and clamp the paper pipe 22. In such a manner, the paper pipe 22 is delivered forward to the cutting device 15 by movement of the belt 142 of each of the two delivery mechanisms 140. When the paper pipe 22 enters the cutting device 15, the paper pipe 22 is placed on the cutting platform 153 and retained by the positioning frame 152 of the cutting device 15. Then, the more than one cutter 151 is moved to cut the paper pipe 22 on the cutting platform 153. At this time, the more than one cutter 151 is moved with the positioning frame 152 and executes a movable cutting work to cut the paper pipe 22 at constant time and constant position. It is noted that, after the paper pipe 22 passes through the sensor 154 during a preset time, the sensor 154 triggers the positioning frame 152 to drive the more than one cutter 151 to perform a cutting work, such that the drinking straws 2 have the same length. In such a manner, the more than one cutter 151 is moved with the positioning frame 152, to cut the paper pipe 22 on the cutting platform 153 to form the drinking straws 2. Finally, the drinking straws 2 are delivered by the conveyor device 14 into a storage barrel 3.

Figure 11:
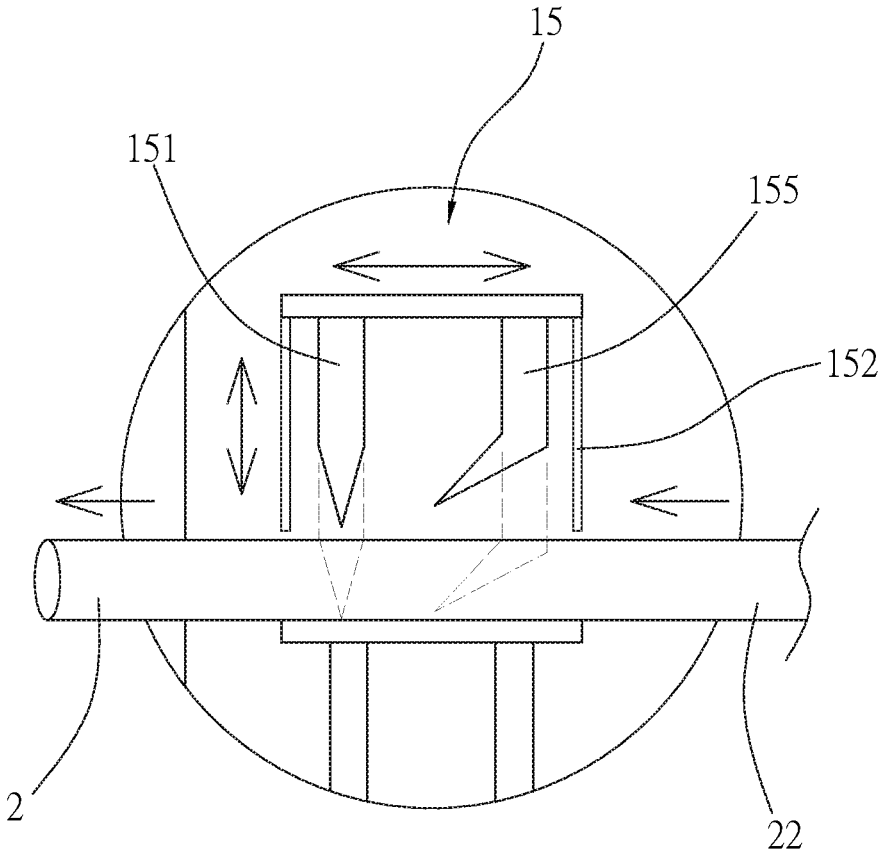
FIG. 11 is a schematic operational view of the cutting device.
Figure 12:
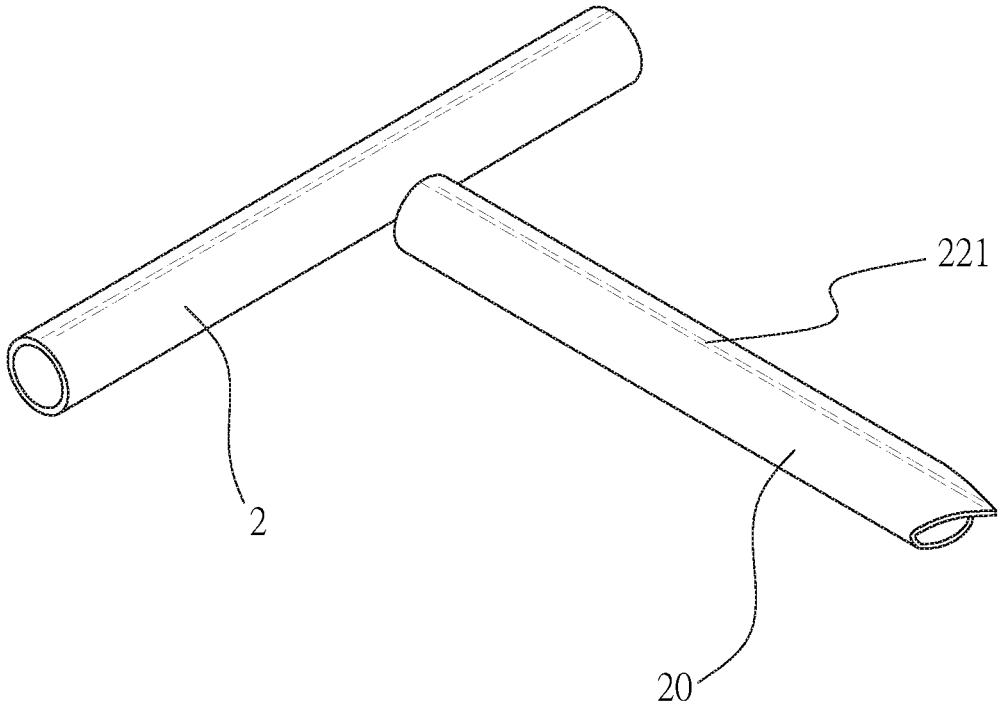
FIG. 12 is a perspective view of two paper drinking straws of different types.

Referring to FIGS. 11 and 12, the more than one cutter 151 has a flat shape, and the cutting device 15 further includes at least one oblique cutting blade 155 arranged beside the more than one cutter 151. Thus, the more than one cutter 151 and the at least one oblique cutting blade 155 are moved downward alternately to cut the paper pipe 22, so as to form a pointed head drinking straw 20 having a flat first end and an oblique second end.

Accordingly, the hot air pipe 132 blows hot air toward the paper material 21 to hot melt the surface of the paper material 21, and to overlap and connect the two sides of the paper material 21, and the press roll 134 uses a high frequency or ultrasonic wave to hot press and stick the two abutting portions 221 of the paper pipe 22 together, such that the drinking straw 2 does not contain adhesive residual and has a lower cost of fabrication. In addition, the paper material 21 is delivered automatically by the straw forming machine 1, the curled paper material 21 is hot melt by the hot air and is rolled by the press roll 134 to form the paper pipe 22, and the paper pipe 22 is cut by the cutting device 15 to form the drinking straw 2, such that the paper material 21 is made into the paper pipe 22 without needing adhesive. Further, the straw forming machine 1 consumes less paper material, has a simplified construction, is operated easily, and has a high working efficiency. Further, the drinking straw 2 is made easily and quickly, and has a low cost of production. Further, the drinking straw 2 achieves an environmental protection purpose. Further, the drinking straw 2 is formed integrally.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A straw forming machine comprising:

a feeding device, a pressing device, a sticking device, a conveyor device, and a cutting device;

wherein:

the feeding device includes a plurality of drawing rollers for feeding, leveling, calibrating and stretching a paper material;

the pressing device is located in front of the feeding device, to curl two sides of the paper material upward;

the pressing device includes a first press plate, a second press plate, a third press plate, a fourth press plate, and a bottom plate;

each of the first press plate, the second press plate, the third press plate, and the fourth press plate gradually tapers downward and forms a first arcuate portion, a second arcuate portion, a third arcuate portion, and a fourth arcuate portion;

the first arcuate portion, the second arcuate portion, the third arcuate portion, and the fourth arcuate portion gradually changes and tapers from a semicircular shape into a circular shape;

the pressing device further includes a first rolling ball mounted on a bottom of the first arcuate portion, a second rolling ball mounted on a bottom of the second arcuate portion, a third rolling ball mounted on a bottom of the third arcuate portion, and a fourth rolling ball mounted on a bottom of the fourth arcuate portion;

the bottom plate is arranged under the first press plate, the second press plate, the third press plate, and the fourth press plate;

the bottom plate is changed corresponding to variation of the first arcuate portion of the first press plate, the second arcuate portion of the second press plate, the third arcuate portion of the third press plate, and the fourth arcuate portion of the fourth press plate, and gradually changes and tapers from a semicircular shape into a circular shape;

the bottom plate has two sides each formed with a clamping slit positioning each of the two sides of the paper material;

the sticking device is located in front of the pressing device, to overlap and adhere the two sides of the paper material, to form a paper pipe;

the sticking device includes a mounting tube, an air inlet pipe connected to the mounting tube, a hot air pipe located above the mounting tube, a forming hole mounted on the mounting tube, and a press roll located above the mounting tube;

the mounting tube is provided with a plurality of vent holes;

the air inlet pipe introduces air into the mounting tube;

the conveyor device is located in front of the sticking device to deliver the paper pipe;

the conveyor device includes two delivery mechanisms located at two sides of the paper pipe and clamping the paper pipe;

each of the two delivery mechanisms includes two rollers and a belt mounted around the two rollers;

the cutting device is located in front of the conveyor device, to cut the paper pipe into a plurality of drinking straws; and the cutting device includes more than one cutter, a positioning frame, and a cutting platform.

2. The straw forming machine of claim 1, wherein the cutting device further includes at least one oblique cutting blade arranged beside the more than one cutter.

3. The straw forming machine of claim 1, wherein the when the paper material passes through the forming hole of the sticking device, the two sides of the paper material are curled and form the paper pipe which has two abutting portions overlapping each other.

4. The straw forming machine of claim 1, wherein the the press roll of the sticking device has a high frequency or ultrasonic wave, to hot press the two abutting portions of the paper pipe and stick the two abutting portions of the paper pipe together.

5. The straw forming machine of claim 1, wherein:

the positioning frame of the cutting device is movable upward and downward and movable forward and backward; and the more than one cutter is moved with the positioning frame and performs a movable cutting work corresponding to movement of the paper pipe.

6. The straw forming machine of claim 1, wherein:

a sensor is mounted between the cutting device and the conveyor device, and is electrically connected with the positioning frame of the cutting device; and the sensor starts the positioning frame to drive the more than one cutter to perform a cutting work after the paper pipe passes through the sensor during a preset time.

* * * * *